114-253 SR
5/13/86 XR 4,587,921

United States Patent [19]

Currey

[11] Patent Number: 4,587,921

[45] Date of Patent: May 13, 1986

[54] MOUNTING FOR BOATING EQUIPMENT

[75] Inventor: Larry B. Currey, Mesquite, Tex.

[73] Assignee: CMT Industries, Inc., Mesquite, Tex.

[21] Appl. No.: 622,633

[22] Filed: Jun. 20, 1984

[51] Int. Cl.[4] ..... B63B 29/00

[52] U.S. Cl. ..... 114/363; 114/253; 248/158

[58] Field of Search ..... 114/363, 364, 343, 255, 114/253, 254; 441/68, 69, 73; 297/349; 248/158, 159, 415

[56] References Cited

U.S. PATENT DOCUMENTS

| | | | |
|---|---|---|---|
| 1,224,405 | 5/1917 | Wienstadt | 248/158 |
| 1,636,966 | 7/1927 | Martin | 248/158 |
| 2,379,572 | 7/1945 | Gibson | 248/158 |
| 2,974,625 | 3/1961 | Lang | 114/235 |
| 3,151,910 | 10/1964 | Larson | 297/349 |
| 3,415,475 | 12/1968 | Goodman | 248/158 |
| 3,620,494 | 11/1971 | DeGaston | 248/405 |
| 3,642,320 | 2/1972 | Ward | 297/345 |
| 3,802,374 | 4/1974 | Brown | 114/235 |
| 3,825,962 | 7/1974 | Grounds et al. | 297/250 |
| 3,890,918 | 6/1975 | Sell | 114/235 |
| 3,919,963 | 11/1975 | Cox | 114/253 |
| 3,949,698 | 4/1976 | Sell | 114/235 |
| 4,008,500 | 2/1977 | Hall | 114/363 |
| 4,030,749 | 6/1977 | Strahm | 297/345 |
| 4,106,143 | 8/1978 | Lucas | 297/384 |
| 4,148,465 | 4/1979 | Bowman | 254/186 |
| 4,221,014 | 9/1980 | Davidson | 211/60 |
| 4,234,989 | 11/1980 | Pearcy | 92/53 |
| 4,278,289 | 7/1981 | Esposito | 297/188 |
| 4,348,051 | 9/1982 | Boucher | 297/423 |
| 4,425,863 | 1/1984 | Cutler | 114/363 |

OTHER PUBLICATIONS

"Boats" Magazine, Mar. 1960, p. 9; Contribution by Bill McAllister.

*Primary Examiner*—Trygve M. Blix
*Assistant Examiner*—C. T. Bartz
*Attorney, Agent, or Firm*—Richards, Harris, Medlock & Andrews

[57] ABSTRACT

An improved seat pedestal assembly (12) is disclosed for use on boats such as a bass boat (10). In the improved design, the extension (71) has a reduced diameter nipple (72) with a threaded portion (74) thereon. The base plate (75) includes a common threaded nut (78) welded to the bottom thereof to receive the threaded portion (74) and to rigidly secure the extension (71) to the base plate (75). In another embodiment, the base plate (96) can be threaded along substantially the entire length of the cylindrical portion (100). The present invention also provides an improved ski tow assembly (14) which is provided with a main support extension having a threaded portion (74, 94) which can be received by the threaded nut (78) on base plate (75) or by the threaded portion on base plate (96).

13 Claims, 8 Drawing Figures

FIG. 1
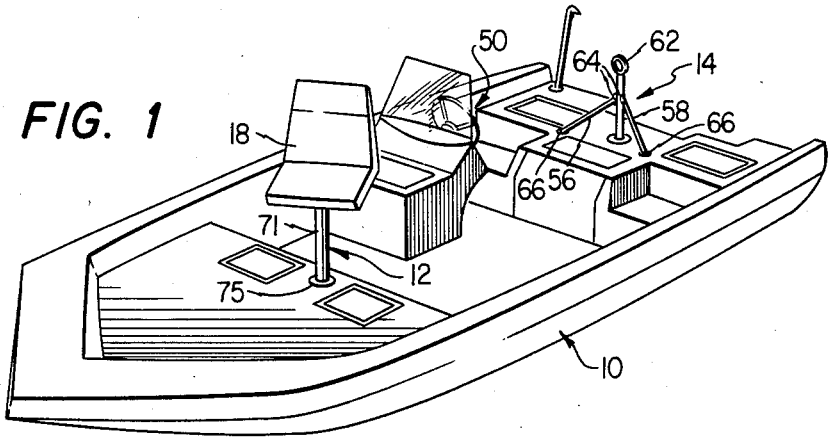
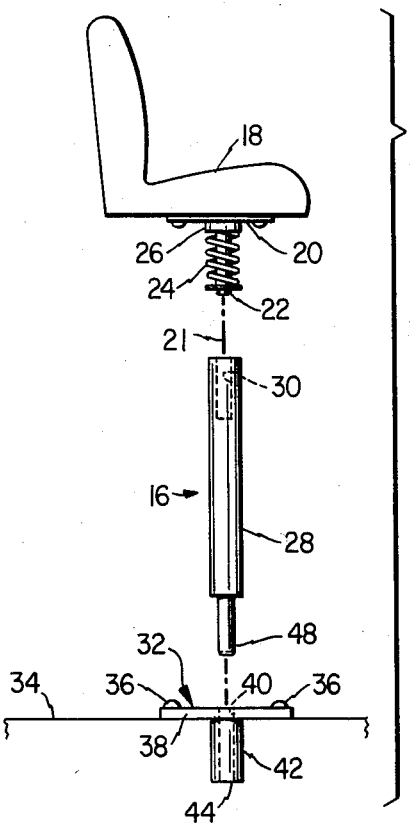
FIG. 2a
(PRIOR ART)
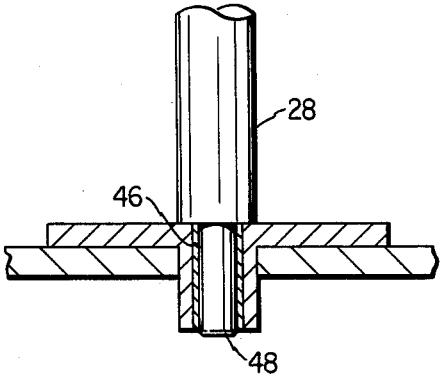
FIG. 2b
(PRIOR ART)

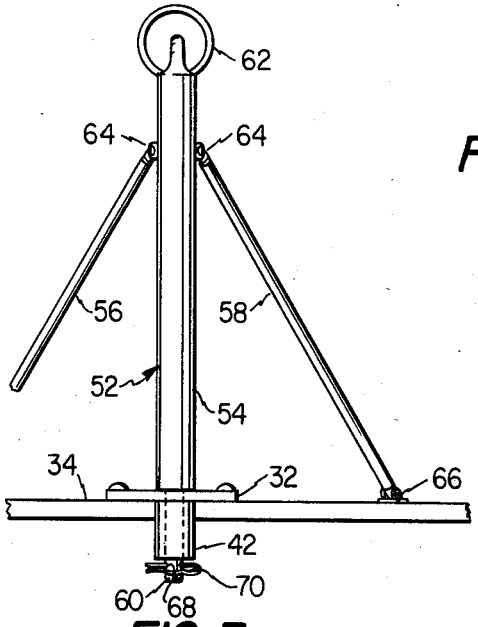
FIG. 3
(PRIOR ART)
FIG. 4
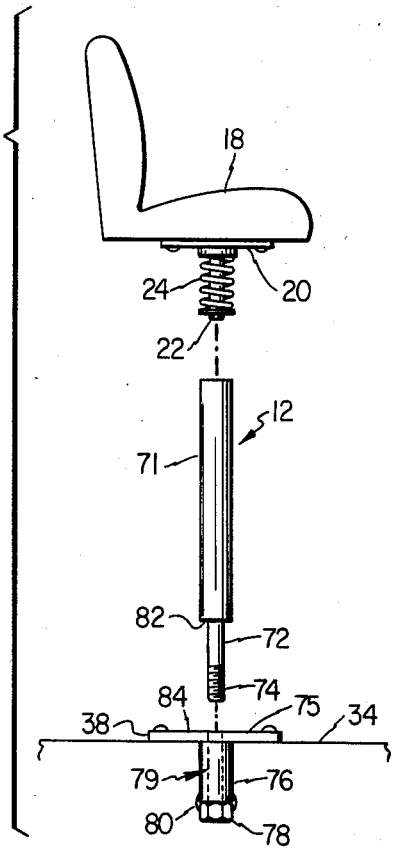
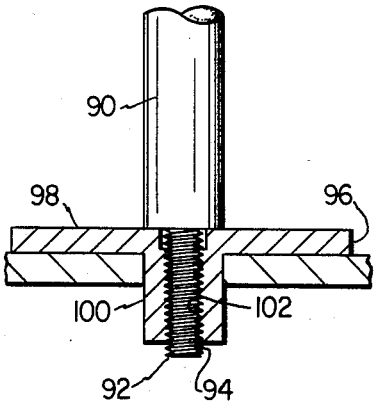
FIG. 5
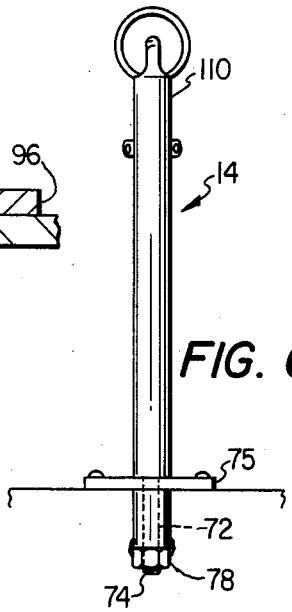
FIG. 6a
FIG. 6b
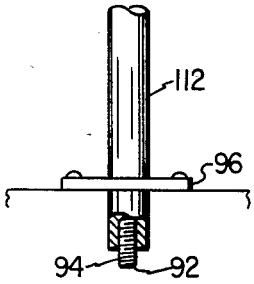

MOUNTING FOR BOATING EQUIPMENT

TECHNICAL FIELD

This invention relates to the boating industry, and in particular to the mounting of seats and ski tows on small boats, including bass boats.

BACKGROUND OF THE INVENTION

Recreational boating is enjoyed by a great number of people. One specific type of boat which has become very popular is the so-called bass boat. While specifically designed for the needs of the bass fisherman, the typical bass boat is quite versatile and has been used for many other functions, including use as a towing boat for water skiing.

Over the years, fishermen have demanded the ultimate in industrial innovation and will flock to an item which has proved successful in assisting in the catch of fish. The typical bass boat has generally been standardized in design as a result of years of development. The steering and engine controls are generally located near the center of the boat, or even slightly towards the stern of the boat. The typical bass boat will include a seat near the bow of the boat for a fisherman and a seat near the stern of the boat for a fisherman. The typical fisherman has come to desire the most comfortable and easily adjustable seat possible. Yet, the seats, particularly in the bow, must generally be removable so that the boat operator can have unrestricted vision forward while travelling to and from fishing sites and for storage.

The industry has developed a pedestal seat assembly which satisfies many of these requirements. Generally the pedestal seat assembly will include the seat, an elongate support extension and a base plate. The base plate is mounted on the boat and supports the seat and extension. The seat and support extension are generally easy to remove or put in place and have proved in general quite comfortable and easy to use.

When a bass boat is employed as a ski boat, it is common to use the base plate of a pedestal seat assembly to form part of the mount for a ski tow. The actual towrope is secured to the ski tow and the ski tow must clearly be mounted to the boat with sufficient strength to resist the forces exerted on it by the water skier.

While the present pedestal seat assemblies, and the base plate used with the pedestal seat assembly and the ski tow have been effective, a need exists for a safer and simpler way for securing the seats and ski tow to the boat.

SUMMARY OF THE INVENTION

In accordance with one aspect of the present invention, a pedestal seat assembly is disclosed for use on a boat having a surface on which to mount the pedestal seat assembly. The assembly includes support structure for supporting the fisherman and a mounting spider on which the support structure is mounted. The mounting spider has a nipple extending along a first direction. An elongate extension is provided which has an aperture in one end thereof for receiving the nipple of the mounting spider which permits the support means and mounting spider to pivot relative to the extension about an axis parallel the first direction. The elongate extension further has a threaded portion at the end opposite the aperture. A base plate is provided for mounting to the surface of the boat. The base plate has a cylindrical member extending through the surface of the boat for receiving the threaded portion of the elongate extension. The cylindrical member has a threaded portion for engaging the threaded portion of the elongate extension to secure the elongate extension to the base plate.

In accordance with another aspect of the present invention, the threaded portion of the base plate is formed by a threaded nut which is welded to a cylindrical section to form the cylindrical member. In another embodiment, the internal surface of the cylindrical member is threaded.

In accordance with yet another aspect of the present invention, a ski tow is provided for mounting on a boat to support a towrope for water skiing. The ski tow includes an elongate extension which has a structure at a first end thereof for attaching a towrope thereto and a threaded portion at the other end thereof. A base plate is mounted on the boat and has a cylindrical member. The cylindrical member has a threaded portion for receiving the threaded portion of the elongate extension to secure the elongate extension to the base plate.

BRIEF DESCRIPTION OF THE DRAWINGS

A more complete understanding of the invention can be had by referring to the following Detailed Description together with the accompanying drawings, wherein:

FIG. 1 is a perspective view of a bass boat equipped with a seat pedestal assembly and ski tow assembly incorporating the present invention;

FIGS. 2*a* and 2*b* are a vertical side view and vertical cross-sectional view of a seat pedestal assembly of the prior art;

FIG. 3 is a vertical front view of a ski tow of the prior art;

FIG. 4 is a vertical side view of the seat pedestal assembly incorporating the present invention;

FIG. 5 is a partial cut away view of a first modification of the seat pedestal assembly of FIG. 4 illustrating the threaded connection between the extension and base plate; and FIGS. 6*a* and 6*b* illustrate partial vertical front views or a ski tow assembly incorporating the present invention.

DETAILED DESCRIPTION

Referring now to the drawings, wherein like reference numerals designate like or corresponding parts throughout the several views, and in particular to FIG. 1, there is illustrated a bass boat 10 which incorporates a seat pedestal assembly 12 embodying the present invention and a ski tow assembly 14 also embodying the present invention.

Seat pedestal assemblies such as assembly 12 have become very critical to the fisherman's enjoyment and success in his sport. The fisherman requires a steady, comfortable and pivotal seat which can be positioned at the ideal height from the deck yet is removable to enhance visibility and for storage.

During fishing, the ski tow assembly 14 is typically replaced with another seat pedestal assembly 12 so that two seating positions are possible. In addition, while the seat pedestal assembly 12 is illustrated as having a full chair like seat 18, it is not uncommon to use a simpler cushion which the fishermen may lean against while standing on the boat 10 itself.

With reference now to FIGS. 2*a* and 2*b*, a prior art seat pedestal assembly 16 is illustrated. The prior art assembly 16 includes a seat 18 mounted on a seat spider 20. The seat spider 20 has a nipple 22 extending along a first direction parallel axis 21 and downwardly from the seat spider as shown. A coil spring 24 is secured to a flange 26 on the seat spider 20 and extends coaxially with the nipple 22.

An elongate extension 28 is provided which has an opening 30 with a circular cross section. The opening 30 is designed to receive the nipple 22 of the seat spider 20 therein. The opening 30 can either be shaped or have bushings lining the interior of the opening 30 to provide adequate support to the nipple 22 to prevent the seat 18 and seat spider 20 from rocking relative to the elongate extension 28. Ideally, the engagement of nipple 22 in the opening 30 should permit the seat 18 and seat spider to rotate only about axis 21, parallel with the long axis of the nipple 22 and opening 30.

A base plate 32 is mounted to the deck 34 of the bass boat by a number of fasteners 36. The base plate 32 generally consists of a flat, rectangular member 38 having a hole 40 therethrough at its center and a cylindrical member 42 with opening 44. The cylindrical member 42 is secured at the underside of the rectangular member 38, as by welding, so that the opening 44 and hole 40 are aligned. Typically, bushings 46 are mounted along the length of the surface defining the opening 44 as shown in FIG. 2*b*.

The lower end of the elongate extension 28 is provided with a reduced diameter nipple 48 which fits into the hole 40 and opening 44 in the base plate 32. Again, the portion of the cylindrical member 42 defining the opening 44 or the bushings 46 should be sufficient to prevent seat 18 and extension 28 from rocking relative to the base plate 32. However, no matter whether bushings are used or not, the mating surfaces of the extension 28 and the base plate 32 are subject to some variance and tolerances which can induce a wobble in the seat 18. As the assembly 16 is used in service, wear also occurs between the mating surfaces of extension 28 and base plate 32, which increases the wobble.

The wobble between extension 28 and base plate 32 is more critical than the wobble between seat 18 and extension 28 because, for equal amounts of wobble at the mating surfaces, the perceived wobble at seat 18 is more severe for the wobble between extension 28 and base plate 32 because the length of extension 28 increases the actual movement due to the wobble. This wobble can be very disturbing and distracting to the fisherman. On occasion, this wobble could even become dangerous and unbalance the fisherman.

When boating from the dock to the fishing site, or between fishing sites, the extension, seat spider and seat for at least the seat pedestal assembly in the bow is removed to permit good forward visibility from the cockpit 50 of the boat where the steering and throttle controls are located. If desired, the extension, seat spider and seat for the seat pedestal assembly in the stern of the boat can also be removed. As can be seen from FIGS. 2*a* and 2*b*, the prior art seat pedestal assembly 16 has only a sliding fit between the elongate extension 28 and the base plate 32. It is therefore quite simple to lift the extension, seat spider and seat from the base plate for storage elsewhere. However, the ease with which the extension can be removed from the base plate can also permit removal accidentally.

Because the typical bass boat is quite powerful and fast, the bass boat is often used as a ski boat. Ski tow assemblies, such as the ski tow assembly 52 illustrated in FIG. 3, have been developed for mounting on a bass boat to attach a ski rope. The prior art ski tow assembly 52 illustrated in FIG. 3 has a tripod configuration with a main support extension 54 and secondary support extensions 56 and 58.

As shown in FIG. 3, the main support extension 54 has a reduced diameter nipple 60 to be received within the base plate 32 at the stern of the boat. The opposite end of the main support extension 54 supports a ring 62 where the towrope can be attached. The secondary support extensions 56 and 58 are secured by couplings 64 near the upper end of the main support extension 54 proximate ring 62. The opposite end of the support extensions 56 and 58 are secured to the deck 34 of the boat 10 by couplings 66.

As can be seen in FIG. 3, the reduced diameter nipple 60 extends through the cylindrical member 42 of the base plate 32 and extends out beyond the lower end of the cylindrical member 42. A hole 68 is formed through the end of the reduced diameter nipple 60 which extends from the cylindrical member 42 to receive a locking pin 70. As will be evidenced from FIG. 3, the locking pin 70 will prevent the main support extension 54 from sliding out of engagement with the base plate 32. While this design is adequate in theory, it has several disadvantages in actual use. First, the ski tow assembly 52 can be mounted with the main support extension 54 fully engaged within the base plate 32 without putting the locking pin 70 in place. This means that the boat operator can tow a skier even though the locking pin 70 is not in place. This could permit the main support extension 54 to pull out of the base plate 32 when a load is put on the ring 62, as by the skier, which could lead to failure of the ski tow assembly 52 and the possibility of harm to the skier. The failure to insert the locking pin 70 within the hole 68 could be attributable simply to the boat operator's forgetting to put it in place. However, because of the awkward position of the hole 68, being below the surface of the deck 34, a boat operator may have a tendency to intentionally fail to put the locking pin 70 in the hole 68, thinking that the ski tow assembly 52 will be safe to operate without it. Naturally, the use of ski tow 52 is also limited to sections of the boat where access to hole 68 is possible when the pin 70 is to be inserted or removed.

FIG. 4 illustrates an improved seat pedestal assembly 12 incorporating the present invention. Many elements of the seat pedestal assembly 12 are identical to elements found in the prior art seat pedestal assembly 16 and are identified by the same reference numerals. However, the elongate extension 71 of seat pedestal assembly 12 has a reduced diameter nipple 72 which has a threaded portion 74. The threaded portion 74 can comprise only a portion of a reduced diameter nipple 72 as shown in FIG. 4 or, can comprise the entire length of the reduced diameter nipple 72 as seen in FIG. 5. The base plate 75 has a cylindrical section 76 which is substantially identical to the cylindrical member 42 as previously described. A threaded nut 78 is fastened at the lower end 80 of cylindrical section 76, as by welding, to form a continuation of section 76 and which together form cylindrical member 79. The threaded nut 78 can comprise a common nut with a hexagonal outer surface. The threads within the threaded nut 78 are preferably sized to receive in threaded engagement the threads of the threaded portion 74 on the extension 71.

When a fisherman wishes to install the seat pedestal assembly 12, the extension 71 will be rotated and pushed into the cylindrical member 79 so that the threaded portion 74 and threaded nut 78 engage and until the flange 82 formed on the extension 71 and the upper surface 84 of the rectangular member 38 are engaged. When this occurs, the extension 71 will be rigidly attached to the base plate 75 and no wobbling of the seat 18 will occur at the connection between the extension 71 and the base plate 75. When removal of the extension is desired, the boat operator need only rotate the extension 71 in the opposite direction to unthread the portion 74 from the nut 78 to remove the extension 71 from the base plate 75 for storage. This insures that the seat pedestal assembly 12 will be very stable and yet easily positioned for use or removed for storage. In addition, the use of a common threaded nut 78 will permit the cost of assembly 12 to be maintained low and the welding of the nut 78 onto a cylindrical section 76 identical to the cylindrical member 42 of the prior art assembly 16 will permit the base plates in inventory for the conventional pedestal seat assemblies to be adapted for use in assembly 12 by simply welding or otherwise fastening the threaded nut 78 thereto. It will also permit the conventional base plate 32 and base plate 75 to be used with a conventional assembly 16 or with the threaded nut 78 and threaded nipple 72 if a manufacturer continues to sell both designs.

With reference now to FIG. 5, a first modification of the seat pedestal assembly 16 of the present invention is disclosed. In this modification, the elongate extension 90 is provided with a reduced diameter nipple 92 which has a threaded portion 94 which extends along the entire length of the nipple 92. The base 96 is formed by retangular member 98 and a cylindrical member 100. The cylindrical member 100 has an aperture 102 which is threaded along its entire length to receive the threads 94 on the nipple 92 to secure the extension 90 to the base plate 96. If desired, the threaded portion 94 need only extend along a part of nipple 92, as does threaded portion 74 in FIG. 4. It will also be apparent that the extensions 71 and 90 can be interchangeably used with either base plates 75 or 76.

The base plates 75 and 96 can also be used with the ski tow assembly 14 as seen in FIGS. *6a* and *6b*. Many of the elements of the ski tow assembly 14 are identical to elements in ski tow assembly 52 and are identified by identical reference numerals. However, the ski tow assembly 14 includes a main support extension 110 which has a reduced diameter nipple 72 with a threaded portion 74 to threadedly engage the nut 78 on base 75 to rigidly secure the main support extension 110 to the base plate 75. Similarly, the ski tow assembly 14 can use an elongate extension 112 which has a reduced diameter nipple 92 with threaded portion 94 thereon for engaging the thread in opening 102 of the base plate 96 to secure the main support extension 112 to the base plate 96. Again, extensions 110 and 112 can be used interchangeably with base plates 75 and 76. Clearly, the ski tow assembly 14 will be rigidly secured to the boat 10 by threadedly engaging the main extension with the appropriate base plate. Moreover, the ski tow assembly 14 cannot be installed without properly threading the main support extension 110 or 112 fully into the base plate. This avoids the potential for an operator to position the ski tow assembly in place without securing it with the pin 70, which was possible in the prior art design. Moreover, the base plates 75 and 96 can be secured to a portion of the boat where access to the cylindrical member 79 and 100 is not possible because no access to either member 79 or 100 is necessary in order to fully secure the main extension 110 or 112 to respective base plates.

Therefore, the design in the seat pedestal assembly 12 and the ski tow assembly 14 of the present invention provides enhanced stability and safety to both the seats used in a boat such as bass boat 10 and also to the use of a ski tow. This advantage is achieved with a minimum of additional cost and materials and is easily used by a boat operator in the field. Moreover, the threaded engagement of the various components of the assemblies 12 and 14 require the operator to properly thread the components together for them to be used, thereby providing a fail-safe method of insuring the operator will install the assemblies correctly.

Although a single embodiment of the invention has been illustrated in the accompanying drawings described in foregoing Detailed Description, it will be understood that the invention is not limited to the embodiments disclosed, but is capable of numerous rearrangements, modifications and substitutions of parts and elements without departing from the spirit of the invention.

I claim:

1. A pedestal seat assembly for use on a boat having a surface to mount the pedestal seat assembly, comprising:

support means on which a person can be supported;

a mounting spider, the support means being mounted on the mounting spider, the spider having a nipple extending along a first direction;

an elongate extension having an aperture in one end thereof for receiving the nipple of said mounting spider and permitting the support means and mounting spider to pivot relative to the extension about an axis parallel to the first direction, said elongate extension further having a threaded portion at the end opposite the aperture; and a base plate for mounting to the surface of the boat, said base plate having a cylindrical member for receiving the threaded portion of the elongate extension, the cylindrical member having a threaded portion for engaging the threaded portion of the elongate extension to secure the elongate extension to the base plate, the threaded connection between the elongate extension and base plate being adapted for frequent removal of the elongate extension to improve visibility during boat movement, the threaded connection of the elongate extension and base plate reducing wear induced wobble when compared to conventional pedestal seat assemblies using a sliding fit therebetween.

2. The pedestal seat assembly of claim 1 wherein said cylindrical member includes a cylindrical section having a relatively smooth interior surface and a threaded nut defining the threaded portion, said threaded nut being secured at one end of the cylindrical section so that the nipple on said elongate extension can be pass through the interior surface of the cylindrical section and threadedly engage the nut.

3. The pedestal seat assembly of claim 2 where the interior portion of said cylindrical member is threaded along its substantially entire length.

4. The pedestal seat assembly of claim 1 wherein said base plate is adapted for use with a ski tow assembly, said ski tow assembly having a main support extension with a nipple extending from end thereof, said nipple having a threaded portion, said nipple of said main support extension for engaging said base plate so that the threaded portions of said main support extension and base plate engage to secure the ski tow assembly to the boat.

5. A pedestal seat assembly for use on a boat having a surface to mount the pedestal seat assembly, comprising:

a support means on which a person can be supported;

a seat spider, the support means being mounted on the seat spider, the seat spider having a nipple extending along a first direction;

an elongate extension having an aperture in one end thereof for receiving the nipple of said seat spider and permitting the seat spider to pivot relative to the extension about an axis parallel the first direction, said elongate extension further having a reduced diameter nipple at the end opposite the aperture, at least a portion of said nipple being threaded on its exterior surface; and a base plate for mounting to the surface of the bass boat, said base plate including a plate member supported on the surface of the bass boat and a generally cylindrical member extending from the plate member through the surface of the bass boat, said cylindrical member having a threaded portion along at least a portion of its interior surface so that the threaded portion of the elongate extension can be threaded into the threaded portion of the base plate to engage the annular surface defined on the elongate extension between the reduced diameter nipple and the remainder of the elongate extension and the top surface of the base plate to secure to elongate extension to the base plate, the threaded connection between the elongate extension and base plate being adapted for frequent removal of the elongate extension to improve visibility during boat movement, the threaded connection of the elongate extension and base plate reducing wear induced wobble when compared to conventional pedestal seat assemblies using a sliding fit therebetween.

6. The pedestal seat assembly of claim 5 wherein said cylindrical member includes a first cylindrical section having a non-threaded internal surface and an internally threaded nut secured at the end of the cylindrical section spaced from the plate for defining the threaded portion of the cylindrical member.

7. The pedestal seat assembly of claim 5 wherein the internal surface of the cylindrical member is threaded along substantially its entire length to define the threaded portion thereof.

8. The pedestal seat assembly of claim 5 wherein said base plate is adapted to receive the main support extension of a ski tow assembly, the main support extension having a reduced diameter nipple with at least a portion thereof threaded to engage the threaded portion of the base plate until the annular surface between the reduced diameter nipple of the main support extension and the remainder of the main support extension contacts the top surface of the base plate so that the main support extension is secured to the base plate.

9. A base plate for use in a pedestal seat assembly, the pedestal seat assembly further including an extension, said base plate for mounting on a boat having a surface to mount the base plate, comprising:

a surface member for being secured to the surface of the boat by fasteners; and a generally cylindrical member secured to the surface member and extending through the surface of the boat, the interior of the cylindrical member defining a surface, at least a portion of said surface being threaded, the extension being threadedly received in the generally cylindrical member, the base plate permitting frequent removal of the extension to improve visibility during boat movement, the threaded attachment reducing the wobble induced in conventional pedestal seat assemblies using a sliding fit between the extension and base plate.

10. The base plate of claim 9 wherein said generally cylindrical member comprises a cylindrical section, the interior of said cylindrical section being generally circular in cross section, and an internally threaded nut secured to one end of the cylindrical section, the internal threads of the nut defining the threaded portion of the cylindrical member.

11. The base plate of claim 9 wherein the interior surface of said cylindrical member is threaded along substantially its entire length.

12. The base plate of claim 9 further defining a pedestal seat assembly, the pedestal seat assembly further including:

support means on which a person can be supported;

a mounting spider, the support means being mounted on the mounting spider, the mounting spider having a nipple extending along a first direction;

an elongate extension having an aperture in one end thereof for receiving the nipple of said mounting spider and permitting the support means and the mounting spider to pivot relative to the extension about an axis generally parallel the first direction, said elongate extension further having a threaded portion at the end opposite the aperture, the threaded portion of said elongate extension being engagable with the threaded portion of said base plate to secure the extension to the base plate.

13. The base plate of claim 9 further defining a ski tow assembly, said ski tow assembly including a main support extension having a threaded portion at one end thereof for threaded engagement with the threaded portion of said base plate to secure the main support extension of the ski tow assembly to the base plate.

* * * * *

UNITED STATES PATENT AND TRADEMARK OFFICE

CERTIFICATE OF CORRECTION

PATENT NO. : 4,587,921

DATED : May 13, 1986

INVENTOR(S) : Larry B. Currey

It is certified that error appears in the above-identified patent and that said Letters Patent is hereby corrected as shown below:

Column 2, line 44, change "or" to --of--.
Column 5, line 33, change "retangular" to --rectangular--.
Column 6, line 57, change "pass" to --passed--.

Signed and Sealed this

*Twelfth* Day of *August 1986*

[SEAL]

*Attest:*

DONALD J. QUIGG

*Attesting Officer*

*Commissioner of Patents and Trademarks*